US005439236A

United States Patent [19]

Musil

[11] Patent Number: 5,439,236

[45] Date of Patent: Aug. 8, 1995

[54] APPARATUS FOR SUPPORTING A PAINT STIRRING STICK AND FOR COUPLING TO AN ELECTRIC DRILL

[76] Inventor: Doug Musil, 4148 E. Madura Five, Gulf Breeze, Fla. 32561-3536

[21] Appl. No.: 273,184

[22] Filed: Jul. 11, 1994

[51] Int. Cl.[6] ..... B01F 13/00

[52] U.S. Cl. ..... 279/102; 366/251; 366/331; 366/605

[58] Field of Search ..... 279/102, 103; 408/210, 408/241 R; 81/489; 366/244, 251, 331, 343, 605

[56] References Cited

U.S. PATENT DOCUMENTS 1,281,610 10/1918 Lundahl ..... 366/605 X
3,991,454 11/1976 Wale ..... 408/210 X
5,112,135 5/1992 Rupp ..... 366/343 X

FOREIGN PATENT DOCUMENTS 4101786 4/1992 Japan ..... 81/489

*Primary Examiner*—Z. R. Bilinsky

[57] ABSTRACT

An apparatus for supporting a paint stirring stick and for coupling to an electric drill comprising, in combination, a generally box-like container, the container having large parallel upper and lower walls, and small parallel side walls coupled therebetween, the container having an open front end adapted to receive a stirring stick, the device also having a closed rear end formed of symmetric walls adapted to close the rear end of the container.

4 Claims, 3 Drawing Sheets

FIG. 5
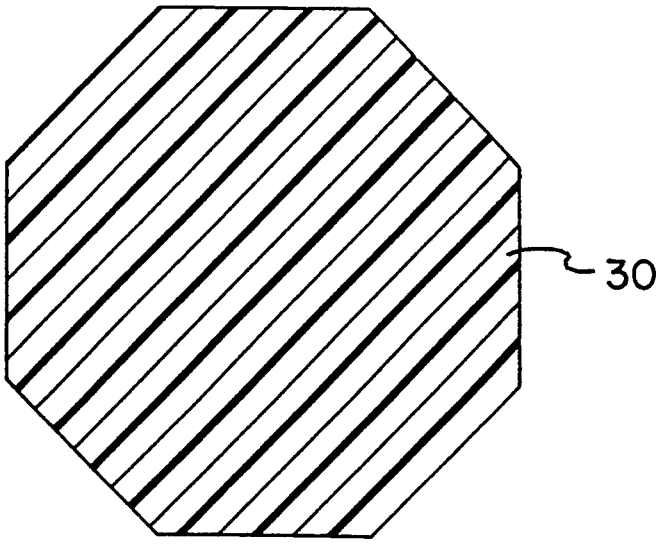
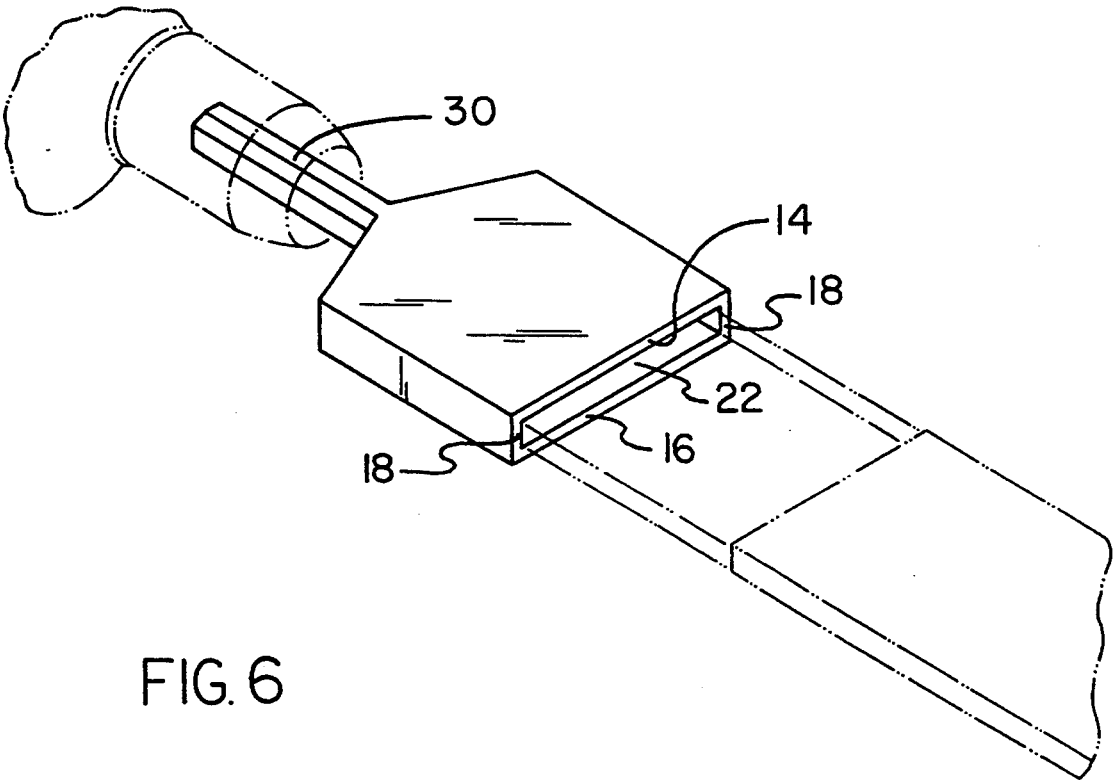
FIG. 6

APPARATUS FOR SUPPORTING A PAINT STIRRING STICK AND FOR COUPLING TO AN ELECTRIC DRILL

BACKGROUND OF THE INVENTION

1. Field of the Invention

The present invention relates to an apparatus for supporting a paint stirring stick and for coupling to an electric drill and more particularly pertains to stirring paint automatically with a device adapted to be supported and rotated by an electric drill.

2. Description of the Prior Art

The use of various devices for stirring paint with a large number of devices and various devices for attachment to an electric drill is known in the prior art. More specifically, various devices for stirring paint with a large number of devices and various devices for attachment to an electric drill heretofore devised and utilized for the purpose of utilizing electric drills for a wide variety of purposes and stirring paint with a large number of devices are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. Des. 254,418 to Norenberg a paint stirring paddle.

U.S. Pat. No. 4,197,017 to Whelan discloses a paint stirrer paddle.

U.S. Pat. No. 4,884,895 to Rodgers discloses a paint stirrer.

U.S. Pat. No. 4,422,770 to Geible discloses a paint stirrer.

U.S. Pat. No. Des. 290,084 to Klapperich discloses a paint mixer.

In this respect, the apparatus for supporting a paint stirring stick and for coupling to an electric drill according to the present invention substantially departs from the conventional concepts and designs of the prior art, and in so doing provides an apparatus primarily developed for the purpose of stirring paint automatically with a device adapted to be supported and rotated by an electric drill.

Therefore, it can be appreciated that there exists a continuing need for a new and improved apparatus for supporting a paint stirring stick and for coupling to an electric drill which can be used to stir paint automatically with a device adapted to be supported and rotated by an electric drill. In this regard, the present invention substantially fulfills this need.

SUMMARY OF THE INVENTION

In view of the foregoing disadvantages inherent in the known types of various devices for stirring paint with a large number of devices and various devices for attachment to an electric drill now present in the prior art, the present invention provides an improved apparatus for supporting a paint stirring stick and for coupling to a electric drill. As such, the general purpose of the present invention, which will be described subsequently in greater detail, is to provide a new and improved apparatus for supporting a paint stirring stick and for coupling to an electric drill and method which has all the advantages of the prior art and none of the disadvantages.

To attain this, the present invention essentially comprises a new and improved apparatus for supporting a paint stirring stick and for coupling to an electric drill comprising, in combination, a generally box-like container, the container having large parallel upper and lower walls, and small parallel side walls coupled therebetween, the container having an open front end adapted to receive a stirring stick, the device also having a closed rear end formed of symmetrically tapering walls adapted to close the rear end of the container, the side walls formed at an angle of about 120 degrees from the parallel side walls; a drive shaft extending rearwardly from the rear end for being received by an electric drill, the drive shaft having acylindrical shape with a hexagonal cross-section, the length of the drive being essentially the length of the side-walls; projections formed within the recess on the facing interior surfaces of the walls, the projections extending inwardly with a semi-circular configurations to about 1/16 inch to facilitate the gripping of a stirring stick when inserted within the recess, the opening having a depth of between about 25 percent and 50 percent of the length of the device walls.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for supporting a paint stirring stick and for coupling to an electric drill which has all the advantages of the prior art various devices for stirring paint with a large number of devices and various devices for attachment to an electric drill and none of the disadvantages.

It is another object of the present invention to provide a new and improved apparatus for supporting a paint stirring stick and for coupling to an electric drill which may be easily and efficiently manufactured and marketed.

It is a further object of the present invention to provide a new and improved apparatus for supporting a paint stirring stick and for coupling to an electric drill which is of a durable and reliable construction.

An even further object of the present invention is to provide a new and improved apparatus for supporting a paint stirring stick and for coupling to an electric drill which is susceptible of a low cost of manufacture with regard to both materials and labor, and which accordingly is then susceptible of low prices of sale to the consuming public, thereby making such various devices for stirring paint with a large number of devices and various devices for attachment to an electric drill economically available to the buying public.

Still yet another object of the present invention is to provide a new and improved apparatus for supporting a paint stirring stick and for coupling to an electric drill which provides in the apparatuses and methods of the prior art some of the advantages thereof, while simultaneously overcoming some of the disadvantages normally associated therewith.

Still another object of the present invention is to stir paint automatically with a device adapted to be supported and rotated by an electric drill.

Lastly, it is an object of the present invention to provide a new and improved apparatus for supporting a paint stirring stick and for coupling to an electric drill comprising a generally box-like container, the container having large parallel upper and lower walls, and small parallel side walls coupled therebetween, the container having an open front end adapted to receive a stirring stick, the device also having a closed rear end formed of symmetric walls adapted to close the rear end of the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional illustration taken along line 5—5 of FIG. 3.

FIG. 6 is an exploded perspective view of the device illustrating its coupling with respect to an electric drill and the stirring stick to be rotated.

The same reference numeral refers to the same part throughout the various figures.

DESCRIPTION OF THE PREFERRED EMBODIMENT

Figure 1:
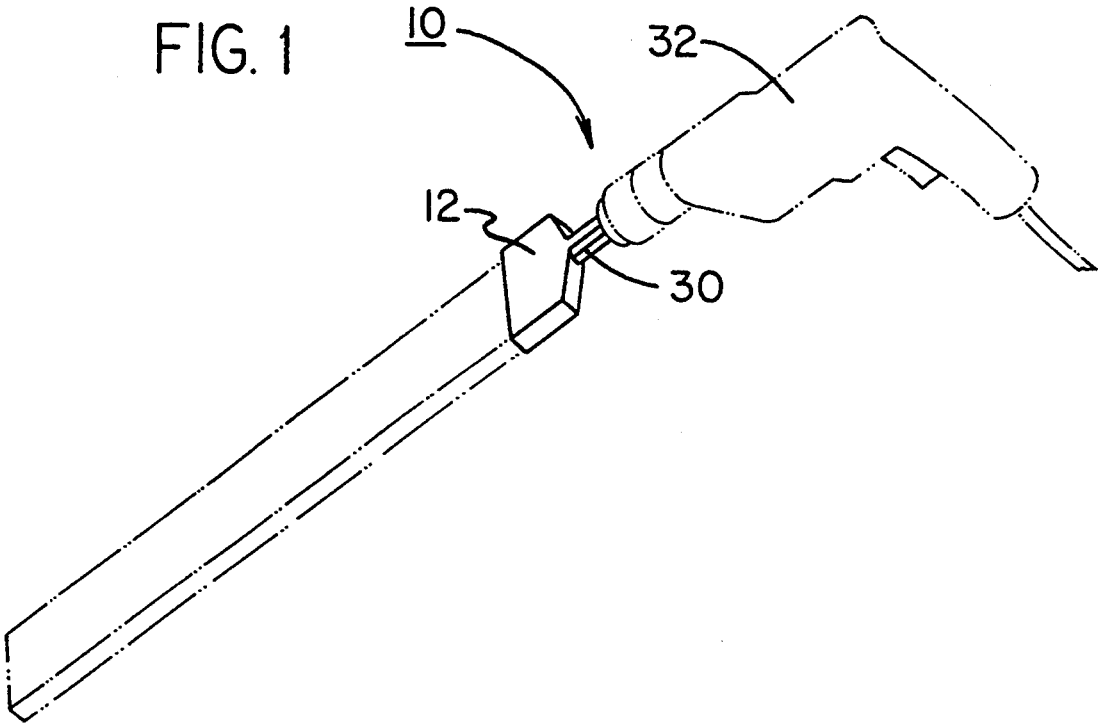
FIG. 1 is a perspective illustration of the preferred embodiment of the new and improved apparatus for supporting a paint stirring stick and for coupling to an electric drill constructed in accordance with the principles of the invention.
Figure 2:
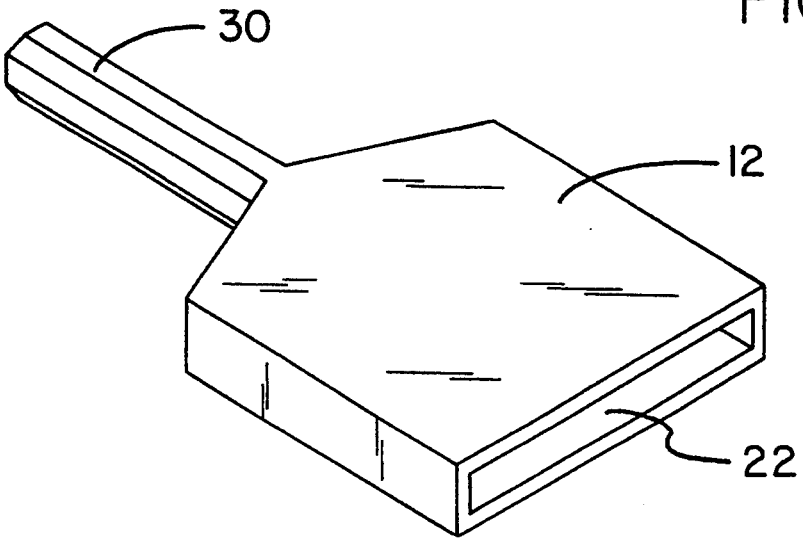
FIG. 2 is an enlarged perspective view of the device shown in FIG. 1 but illustrating it from the opposite side thereof.
Figure 3:
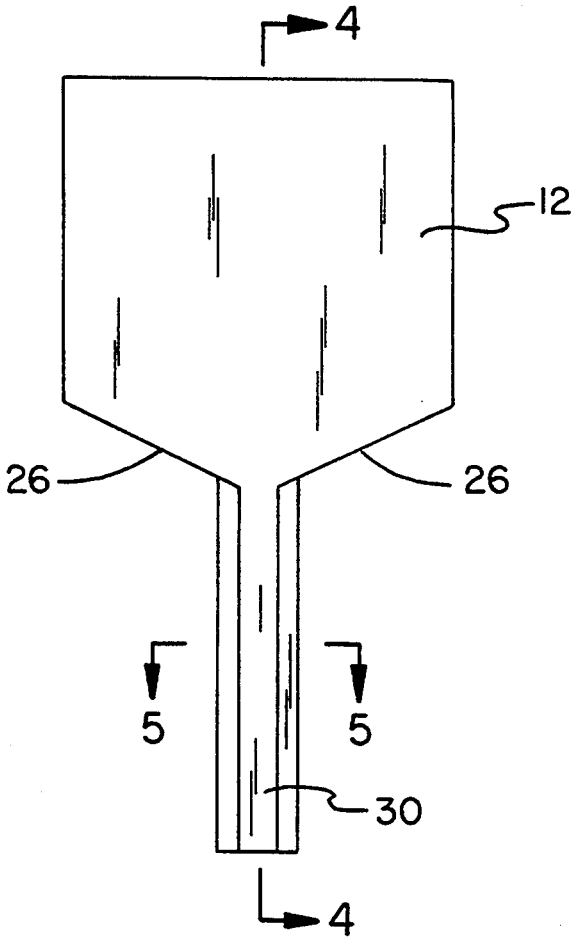
FIG. 3 is a top elevational view of the device of the prior Figure.
Figure 4:
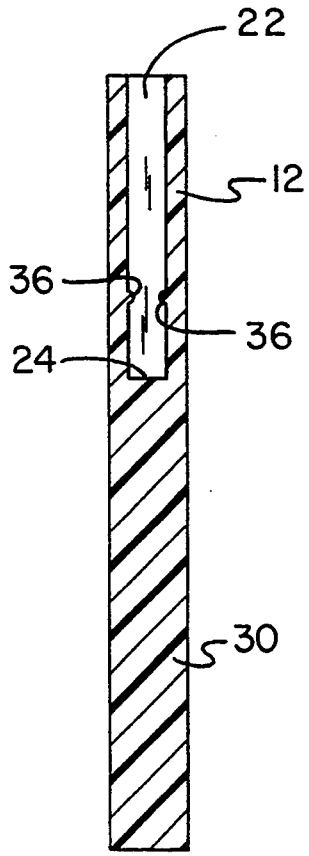
FIG. 4 is a cross-sectional illustration taken along line 4—4 of FIG. 3.

With reference now to the drawings, and in particular to FIG. 1 thereof, a new and improved apparatus for supporting a paint stirring stick and for coupling to an electric drill embodying the principles and concepts of the present invention and generally designated by the reference numeral 10 will be described.

The present invention, the new and improved apparatus for supporting a paint stirring stick and for coupling to an electric drill is a system 10 comprised of a plurality of components. Such components include, in their simplest terms, a box-like container and projections formed within a recess of the container. Such components are individually configured and correlated with respect to each other so as to obtain the desired objective.

The central component of the system 10 of the present invention is a box-like container 12. The container has large parallel upper and lower walls 14, 16 in a rectangular configuration. It also has small parallel side walls 18 coupling the upper and lower walls to form a rectangular cross-sectional configuration. The width of the cross-section formed by the walls is between about eight and twelve times the height, preferably about ten times the height. The depth is approximately equal to the width.

The container also has an open front end 22 adapted to receive a stirring stick. It also has a closed rear end 24. The rear end is formed of symmetrically tapering walls 26 adapted to close the rear end of the container. The side walls are formed at an angle of about 120 degrees, preferrably between 100 and 140 degrees, from the parallel side walls.

Next provided is a drive shaft 30. The drive shaft is formed as an extension extending rearwardly from the rear end of the container. The drive shaft is for being received in an electric drill 32. The drive shaft has a cylindrical shape with a hexagonal cross-section. Note FIG. 5. The length of the drive shaft is essentially equal to the length of the side wall.

The container is formed of a rigid material, preferrably plastic.

The next component of the system are projections 36. The projections are formed within the recess on the facing interior surfaces of the walls. The projections extend inwardly toward each other and have a semi-circular configuration. They are about 1/16th inch in extent to facilitate the dripping of a stirring stick by friction when inserted within the recess.

The opening and recess have a depth of between about 25 and 50 percent of the length of the device including container and drive shaft.

The present invention is a reusable holder for the wooden stirrer commonly provided with cans of paint, stain, etc. The present invention is lightweight, has no moving parts, and can be molded from recycled plastic.

The top has a hex shank, $\frac{1}{4}$ inch diameter, which allows the present invention to be inserted into the chuck of an electric drill or electric drill screwdriver.

The bottom portion of the present invention has a sleeve which tightly grips the wooden stirrer.

Together, the drill with the present invention and wooden stirrer become a power mixer for paints, stains and other liquids. Currently, two options exist for mixing paint in a can, a wooden stirrer with hands or a conventional paint mixing attachment with electric drill. The present invention combines the best advantages for both options into one product. The present invention saves time in two ways. It reduces the time required to thoroughly mix paint by hand, using the speed of a power tool. It also reduces clean-up time associated with conventional paint mixing attachments which must be washed after every use. The present invention is good for the environment as it eliminates the wasteful use of clean water, or chemicals, necessary to wash conventional paint mixing attachments.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for supporting a paint stirring stick and for coupling to an electric drill comprising, in combination:

a generally box-like container, the container having large parallel upper and lower walls, and small parallel side walls coupled therebetween, the container having an open front end adapted to receive a stirring stick, the device also having a closed rear end formed of symmetrically tapering walls adapted to close the rear end of the container, the side walls formed at an angle of about 120 degrees from the parallel side walls;

a drive shaft extending rearwardly from the rear end for being received by an electric drill, the drive shaft having a cylindrical shape with a hexagonal cross-section, the length of the drive being essentially the length of the side walls;

projections formed within the recess on the facing interior surfaces of the walls, the projections extending inwardly with a semi-circular configurations to about 1/16 inch to facilitate the gripping of a stirring stick when inserted within the recess, the opening having a depth of between about 25 percent and 50 percent of the length of the device walls.

2. An apparatus for supporting a paint stirring stick and for coupling to an electric drill comprising:

a generally box-like container, the container having large parallel upper and lower walls, and small parallel side walls coupled therebetween, the container having an open front end adapted to receive a stirring stick, the device also having a closed rear end formed of symmetric walls adapted to close the rear end of the container; and a drive shaft extending rearwardly from the rear end for being received by an electric drill, the drive shaft having a cylindrical shape with a hexagonal cross-section, the length of the drive being essentially the length of the side walls.

3. The apparatus as set forth in claim 2 and further including projections formed within the recess on the facing interior surfaces of the upper and lower walls, the projections extending inwardly with the semi-circular configurations to about 1/16 inches to facilitate the gripping of the stirring stick when inserted within the recess, the opening being about one inch in width and about $\frac{1}{4}$ inch in height and about one inch in depth.

4. The device as set forth in claim 2, wherein the width of the recess is between about eight and twelve times the height thereof and the depth is essentially equal to the width.

* * * * *